US005584196A

United States Patent [19]

Taylor et al.

[11] Patent Number: 5,584,196

[45] Date of Patent: Dec. 17, 1996

[54] KNITTING PLIED ELASTIC YARN ON A FULL FASHION FLAT BED KNITTING MACHINE

[75] Inventors: Richard Taylor, Loughborough; John Hubbard, Thringstone; Derek Else, Mansfield; David Patel, Long Eaton, all of Great Britain

[73] Assignee: CV Apparel Limited, Nottinghamshire, England

[21] Appl. No.: 424,536

[22] PCT Filed: Nov. 30, 1993

[86] PCT No.: PCT/GB93/02467

§ 371 Date: Aug. 14, 1995

§ 102(e) Date: Aug. 14, 1995

[87] PCT Pub. No.: WO94/12711

PCT Pub. Date: Jun. 9, 1994

[30] Foreign Application Priority Data

Dec. 3, 1992 [GB] United Kingdom ..... 9225302.0

[51] Int. Cl.[6] ..... D04B 1/18

[52] U.S. Cl. ..... 66/60 R; 66/172 E

[58] Field of Search ..... 66/172 E, 178 A, 66/189, 195

[56] References Cited

U.S. PATENT DOCUMENTS

| | | | |
|---|---|---|---|
| 2,133,840 | 10/1938 | Anderson . | |
| 2,330,445 | 9/1943 | Patton | 66/189 X |
| 2,720,097 | 10/1955 | DeMond . | |
| 4,326,393 | 4/1982 | Dunlap | 66/172 E |
| 4,499,742 | 2/1985 | Burn | 66/172 E |
| 5,103,656 | 4/1992 | Hamson, II . | |

FOREIGN PATENT DOCUMENTS

| | | |
|---|---|---|
| 119536 | 9/1984 | European Pat. Off. . |
| 303922 | 2/1989 | European Pat. Off. . |
| 431984 | 6/1991 | European Pat. Off. . |
| 680028 | 4/1930 | France . |
| 1812285 | 7/1969 | Germany . |
| 3641182 | 2/1988 | Germany . |

OTHER PUBLICATIONS

Patent for Tubular Knit on V–Bed, Knitting International, Jun. 1996 p. 66.

Die Wirkerei und Strickerei, K. Weber, Melliand 1981, pp. 55–56.

*Primary Examiner*—John J. Calvert

*Attorney, Agent, or Firm*—Robert A. Felsman; Mark D. Perdue

[57] ABSTRACT

A method of knitting on a full fashion flat bed knitting machine where a face yarn and a plated yarn are used in combination. The method includes knitting an inelastic yarn on the face of the fabric and knitting an elastic yarn on the back of the fabric in plated relationship. Two separate yarn carriers are used to deliver the yarn to the needles where the carries are offset from each other by at least one needle width.

3 Claims, 1 Drawing Sheet

KNITTING PLIED ELASTIC YARN ON A FULL FASHION FLAT BED KNITTING MACHINE

BACKGROUND OF THE INVENTION

This invention relates to knitting.

1. Field of the Invention

It is known to use elastic threads such as those known by the names Lycra and Spandex (Registered Trade Marks) in various knitting techniques to produce stretch fabrics. Elasticised fabrics are made by laying in (power net) or knitting (stretch tricot) elastane or elastomeric yarns in warp knitting while in weft knitting elastic yarns are inlaid to produce elastically extensible fabrics.

2. Background Information

In U.S. Pat. No. 2,133,840 a dial and cylinder circular knitting machine produces two-way stretch fabrics for foundation garments in which an elastic body thread and an inelastic body thread are knitted to form connected but separate stitch loops and an auxiliary thread has ancillary loops knitted with certain of the body loops and long terry loops that project from one face of the fabric. The terry loops are deployed next to the wearer's skin for added comfort.

U.S. Pat. No. 2,720,097 discloses stretch heel and toe portions of tubular hosiery—so-called "surgical stockings"knitted from a wrapped elastic thread. At the heel and toe portions, a monofilament nylon year is introduced. With the elastic thread under a slight tension, the monofilament nylon thread plates to one face of the knitting which is then turned inside out so that the plated nylon thread is adjacent the heel or toe in use, for added comfort.

EP-0119 536-A1 discusses difficulties which arise when using a flat bed machine to knit an elastic yarn together with a ground yarn. In one arrangement, the ground yarn and elastic yarn are fed together to the yarn guide with the elastic yarn being taken through the ground yarn spool so that the ground yarn wraps around the elastic yarn. In another embodiment, the two yarns are fed separately using a plating thread guide so that the elastic yarn is plated by the ground yarn. In any event, it is necessary to give to the elastic yarn a definite pretension, which, seemingly, can only be done using a certain type of tensioner, namely a sintered ceramic thread tensioner. This is said to render tolerable the variations in tension in the elastic yarn which are due to the to-and-fro traverse motion of the yarn carrier.

SUMMARY OF THE INVENTION

The present invention provides new elasticated knitting.

The invention comprises a method for knitting comprising knitting two yarns on a straight bar frame so as to plate one of them to the back face of the knitting, characterised in that the knitting is stretch knitting, that one of the yarns is an elastic thread and the other is a face yarn, and that the straight bar frame is a fully fashioned frame.

The knitting may comprise a fully fashioned garment section or a fully fashioned garment.

The elastic thread may extend the full width of the knitting.

With the elastic thread plated on the back face, the front does not display any elastic thread and the knitting may therefore be dyed without the elastic thread showing through because of differential dyeing.

The face yarn and elastic thread may be fed through separate carriers. The elastic thread may be positioned nearest the needle head. The carrier for the elastic thread may precede the carrier for the face yarn, for example by one or two needles in the direction of displacement. The carrier for the face yarn may have a larger traverse than the carrier for the elastic thread.

Such an arrangement is disclosed in DE-PS-36 41 182, which discusses the production of plated fabric on flat bed machines and notes that different devices have been used such as a feeder with a round exit for the plating thread and an elongate exit for the ground thread, or a feeder with upper and lower exits, both fed from a central opening, for the ground and plating threads respectively. This patent proposes a thread guiding arrangement in which a single slider has a fixed and a movable carrier such that the movable carrier has a larger traverse than the fixed carrier, so that the latter always preceded the moveable carrier. The ground thread is fed through the moveable carrier, the plating thread through the fixed carrier.

BRIEF DESCRIPTION OF THE DRAWINGS

Knitting according to the invention will now be described with reference to the accompanying drawings, in which.

DESCRIPTION OF THE PREFERRED EMBODIMENT

Figure 1:
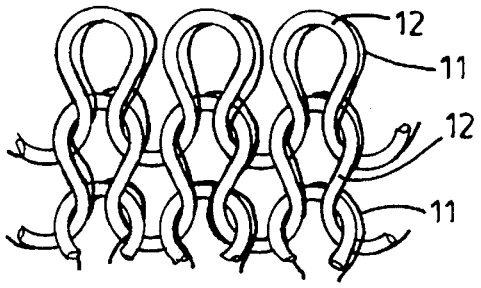
FIG. 1 is a diagrammatic view of the technical face of knitting according to the invention.
Figure 2:
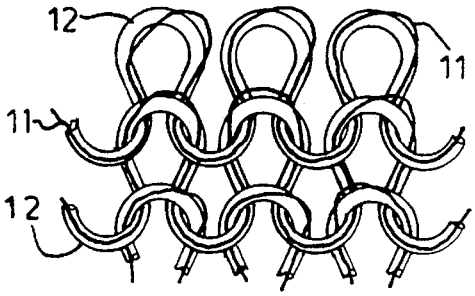
FIG. 2 is a diagrammatic view of the technical back of the knitting of FIG. 1.

FIGS. 1 and 2 illustrates knitting, comprising a plated elastic thread 11. The thread 11 is plated on to the technical back of the knitting. The figures are diagrammatic in that they illustrate the stitch structure rather than the actual appearance. In actuality, the elastic thread 11 will pull the stitches tight to form a dense fabric, but will allow the knitting to be stretched in both courses and wales directions.

The face yarn 12, which can be of a different, usually heavier count than the elastic yarn 11, appears substantially exclusively on the technical face of the knitting so that when the knitting is dyed, differential dyeing effects are not visible. With a heavier face yarn 12, both yarn 12 and elastic thread 11 will be visible on the technical back.

Figure 4:
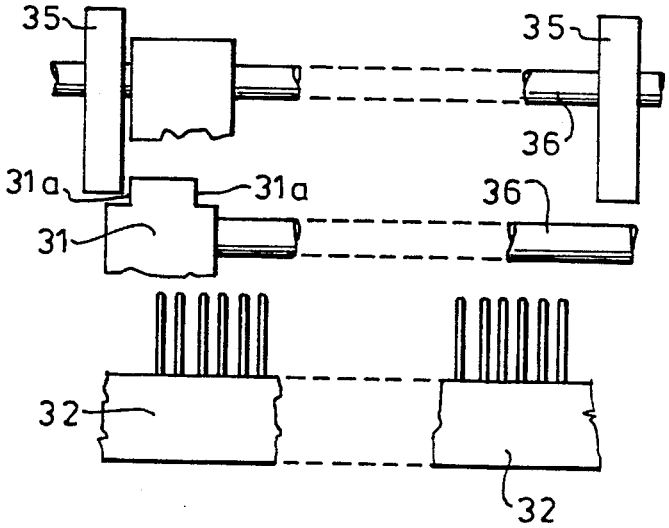
FIG. 4 is a view of the friction box arrangements for the carriers of the frame of FIG. 3.
Figure 3:
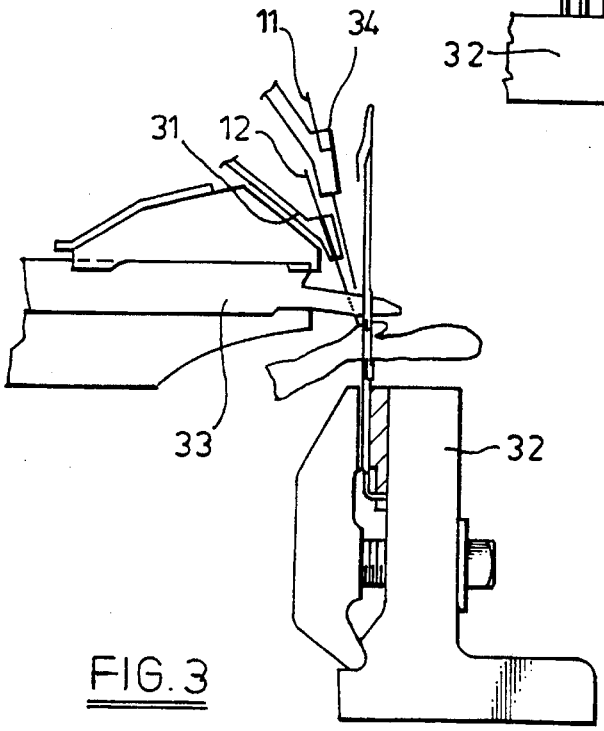
FIG. 3 is a view of the knitting head of a straight bar frame adapted to produce the knitting of FIGS. 1 and 2.

FIGS. 3 and 4 illustrate how the knitting illustrated in FIGS. 1 and 2 can be made using a fully-fashioned straight bar frame.

The standard frame has a single yarn carrier 31 running behind the needle bar 32 above the sinkers 33 (or sinkers and dividers, in a fine gauge machine). The standard frame is modified by the addition of another yarn carrier 34. The carrier 31 feeds the face yarn 12 and the carrier 34 feeds the elastic thread 11 so that it is positioned in the needle nearer the head.

The two carriers 31, 34 have independent movement, elastic thread carrier 34 moving ahead of the face yarn carder 31. The carriers 31, 34 are driven by the usual friction box arrangement, the carder 31 being modified as illustrated in FIG. 4 by having its faces 31*a* that strike the carder stop 35 shaved by one or two needle spaces so that the carrier 31 runs over two or four needles more than the carrier 34. Since both carriers 31, 34 are picked up by the carrier bar 36 reversal at the same time, carrier 34 always runs one or two needles ahead of carrier 31.

We claim:

1. A method of forming a fully-fashioned, elasticated, flat-knit knitted fabric, on a straight-bar fully-fashioned frame having first and second yarn carriers feeding needles terminating in heads formed with hooks, by reciprocating the yarn carriers along needles carried on the frame, the method comprising the steps of:

feeding an elastic thread with said first yarn carrier to the hooks of selected needles of the frame;

feeding a face yarn with said second yarn carrier to the hooks of the same needles as the elastic thread so that the elastic thread and the face yarn are fed to the same needles;

said first yarn carrier being displaced from said second yarn carrier, towards the head ends of the needles, wherein the elastic thread is fed into the needle hooks nearer their head ends than the face yarn, wherein the elastic thread is plated on to the back face of the knitting; and said first yarn carrier preceding said second yarn carrier in their reciprocation along the needles, and traversing over more needles than does the second yarn carrier.

2. A method according to claim 1, further comprising extending the plated elastic thread over the full width of the knitting.

3. A method according to claim 1 or claim 2, further comprising positioning the first yarn carrier before the second yarn carrier by at least one needle space.

* * * * *